United States Patent [19]

Heydrich

[11] Patent Number: 4,796,572

[45] Date of Patent: Jan. 10, 1989

[54] COMBUSTION CHAMBER LINER

[75] Inventor: Hans Heydrich, Phoenix, Ariz.

[73] Assignee: The United States of America as represented by the Secretary of the Army, Washington, D.C.

[21] Appl. No.: 55,962

[22] Filed: Jun. 1, 1987

[51] Int. Cl.[4] ..... F01P 3/00

[52] U.S. Cl. ..... 123/41.42; 123/41.84; 123/193 C; 123/668

[58] Field of Search ..... 123/193 CH, 193 C, 41.72, 123/41.79, 41.83, 41.84, 41.42, 668, 669

[56] References Cited

U.S. PATENT DOCUMENTS

| | | | |
|---|---|---|---|
| 2,783,748 | 3/1957 | Brenneke | 123/41.83 |
| 3,882,842 | 5/1975 | Bailey et al. | 123/193 C |
| 4,328,772 | 5/1982 | Heydrich et al. | 123/193 CH |
| 4,413,597 | 11/1983 | Stang et al. | 123/41.84 |
| 4,562,799 | 1/1986 | Woods et al. | 123/193 C |
| 4,616,603 | 10/1986 | Kubis et al. | 123/193 C |

*Primary Examiner*—Willis R. Wolfe
*Assistant Examiner*—M. Macy
*Attorney, Agent, or Firm*—Peter A. Taucher; David L. Kuhn

[57] ABSTRACT

An uncooled (adiabatic) engine having an insulator sleeve in each cylinder to retard heat flow into the engine wall structure. Each sleeve is yieldably (springably) mounted in an engine bore, such that the sleeve can experience thermal growth in the axial direction without excessive stress or mechanical failure.

14 Claims, 1 Drawing Sheet

COMBUSTION CHAMBER LINER

GOVERNMENT INTEREST

The invention described herein may be manufactured, used, and licensed by or for the Government for governmental purposes without payment to me of any royalty thereon.

BACKGROUND AND SUMMARY OF THE INVENTION

This invention relates to improvements in internal combustion engines, particularly engines of the so-called "uncooled" type. Such engines are sometimes termed "adiabatic" engines (without significant heat loss).

Principal object of the invention is to provide a relatively low cost combustion chamber liner for an adiabatic engine.

THE DRAWINGS

Figure 1:
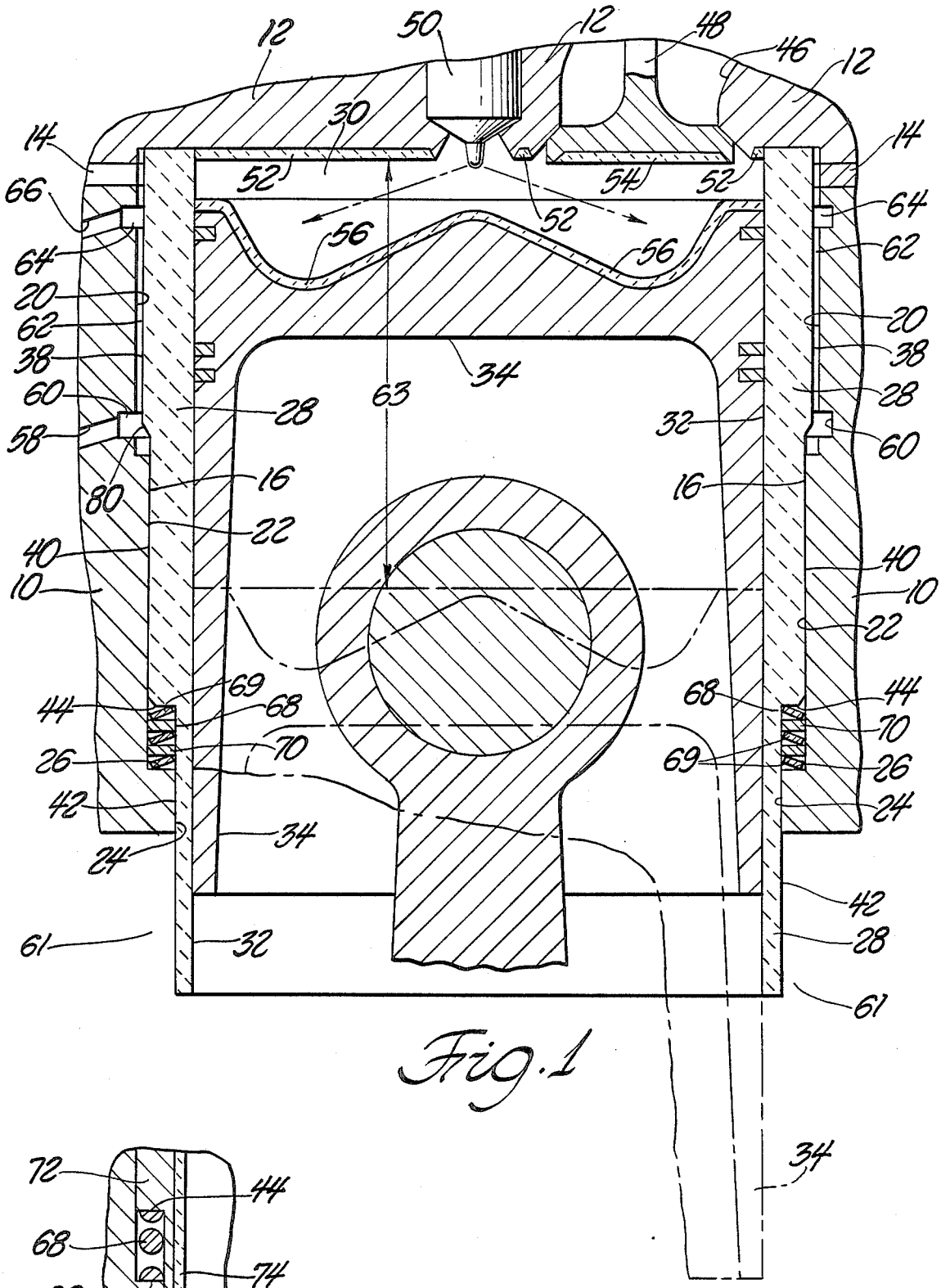
FIG. 1 is a fragmentary sectional view taken through an engine embodying my invention.

Referring in greater detail to FIG. 1, there is shown a diesel engine comprising a cylinder block 10 and cylinder head 12. A gasket 14 is interposed between the mating surfaces of block 10 and cylinder 12. Non-illustrated stud-nut means is used to clamp the head on the block, as per standard practice. The head and block may be formed out of usual engine materials, e.g. cast iron or aluminum, or more novel materials such as metallic or organic polymer-based composites.

Cylinder block 12 has a number of bores 16 therein, one bore for each cylinder; the drawing shows only one cylinder of the engine, but the other cylinders would be similarly constructed. Bore 16 extends from the outer surface of block 10 (at gasket 14) to the crankcase. Bore 16 is of step-like configuration in that it has two or more different diameter sections, e.g. a large diameter bore section 20 in near adjacency to cylinder head 12, an intermediate diameter bore section 22, and a relatively small diameter bore section 24. The juncture between bore sections 22 and 24 defines an annular shoulder 26.

Bore 16 removably accommodates a combustion chamber sleeve 28 that is formed of a material having relatively good insulating properties. The sleeve is designed to act as an annular barrier to flow of heat from combustion chamber 30 to cylinder block 10. Sleeve 28 may be formed of any suitable insulator material, e.g. silicon nitride or other ceramics such as partially stabilized zirconia.

The inner surface 32 of sleeve 28 is of constant diameter from one end of the sleeve to the other, whereby surface 32 functions as a slidable support for a piston 34. The drawing shows the piston in two positions, namely top dead center (full lines), and bottom dead center (dashed lines).

The outer side surface of sleeve 28 is of step configuration, to form a first relatively large diameter surface area 38 in radial alignment with bore section 20, a second intermediate diameter surface area 40 in radial alignment with bore section 22, and a third small diameter surface area 42 in radial alignment with bore section 24. The juncture between surface areas 40 and 42 forms an annular shoulder 44.

Combustion air is supplied to chamber 30 via an intake passage 46 having a conventional poppet valve 48 therein. Diesel fuel is injected into the compressed air charge by means of a conventional fuel injector 50. A thermal barrier such as a plasma spray coating of zirconia ($ZrO_2$) 52 is applied to the lower face area of head 12 that is exposed to the combustion chamber. A similar thermal barrier coating 54 is applied to the lower face of valve 48. Likewise, a similar coating 56 is applied to the upper face of piston 34. The exhaust valve, not shown, would have a coating similar to coating 54.

Zirconia has a low thermal conductivity, e.g. below 1 BTU/hr—ft°F. The zirconia coatings on the upper and lower faces of the combustion chamber serve to retard flow of combustion heat from the chamber into the associated metal surfaces (head 12, valve 48, and piston 34).

My invention does not relate to coatings 52, 54 and 56. Such coatings are shown in the drawings to indicate my intention (desire) that the upper and lower surfaces of the combustion chamber be insulated in some fashion in order to achieve (as much as possible) an adiabatic combustion process. My invention relates to sleeve 28 that defines the annular side surface of the combustion chamber.

As previously noted, each sleeve 28 is removably received in a bore 16. The sleeve insertion process is performed with cylinder head 12 removed from block 10. Head 12 is installed on the block after the various sleeves 28 are in place.

Sleeve surface area 40 preferably has a sliding fit in bore section 22, e.g. a clearance on the order of 0.003 inch. The slight clearance is sufficient to permit a film of oil to be maintained between the two surfaces. The oil film acts as a liquid bearing to isolate the sleeve from the thermal or mechanical distortions of the block that would normally cause out-of-round of the sleeve bore and promote cracking of the ceramic sleeve. The liquid film also acts as a liquid dampener to minimize sleeve vibrations, as would tend to shorten the sleeve life.

Oil is supplied to the sleeve-bore interface via a small line (passage) 58 that is connected to the high pressure side of the lubrication system. Line 58 discharges oil into an annular groove 60 that communicates with an annular clearance space 62 formed between sleeve surface area 38 and bore section 20. Clearance space 62 may have a small radial dimension on the order of 0.010 inch or less, although the clearance dimension is not highly critical.

Oil flows upwardly through clearance space 62 and into an annular groove 64 that connects to a drain line 66. Line 66 discharges to a point in the low pressure side of the lubrication system, such that the pressure differential between lines 58 and 66 produces a continuous flow of oil through clearance space 62. The slight oil pressure in space 62 in intended to be sufficient to produce a small downflow of oil through the clearance space between surfaces 22 and 40 (which communicates with crankcase space 61). Primary oil flow is upwardly through clearance space 62.

Oil flow through space 62 is for the purpose of removing the small amount of heat that passes through the cylinder sleeve. Its flow rate can be adjusted by suitable sizing of orifices, to control the temperature of the inner sleeve surface to a level that does not exceed the operating capability of the piston, sleeve and piston ring tribological contact zones. It also serves to minimize temperature gradients (and hence thermal distortions) of the cylinder block.

The axial length of the thickest section of sleeve 28 is selected to be a substantial percentage of the combustion chamber length, denoted by numeral 63. The relatively great sleeve thickness (at the upper end of chamber 30) retards flow of heat from the hottest areas of chamber 30 to cylinder block 10. It also provides greater strength in the upper portion of the sleeve where combustion pressures are highest.

The engine operates without the usual water jackets that surround the individual cylinders. Block 10 is kept relatively cool solely due to the heat-retarding action of sleeve 28 (and oil flow through space 62). During operation of the engine, sleeve 28 is subjected to mechanical and thermal stresses. The thermal stresses tend to produce an increase in the axial dimension of the sleeve.

Figure 2:
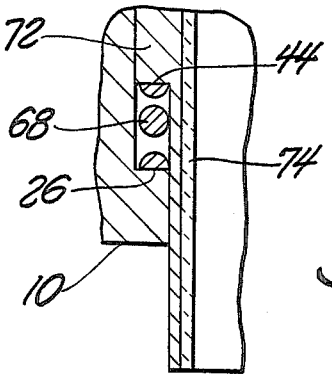
FIG. 2 is a fragmentary sectional view illustrating an alternate combustion chamber liner usable in practice of the invention.

The so-called thermal growth in the sleeve 28 length is absorbed by an annular compression spring means 68 located in an annular space defined by previously-mentioned shoulders 26 and 44. As shown in FIG. 1, the spring means can take the form of multiple belleville washers 69 and annular spacers (flat washers) 70 arranged to give the required preload and stiffness values. The spring means could take other forms, e.g. a coil spring as shown in FIG. 2, or a compressible elastomer such as polyurethane or silicone rubber ring trapped in the annular space between the block and the sleeve.

Spring means 68 has sufficient strength to maintain the upper end of sleeve 28 in pressure contact with the underface or head 12, while at the same time accommodating (or yielding to) axial thermal growth of the sleeve. The combustion pressures in space 30 act on sleeve 28 primarily in radial directions (not axial directions). Therefore spring means 68 does not have to be of such high strength as might fracture or otherwise destruct the sleeve. The spring means is preferably located near the lower end of sleeve 28 where the temperatures are not high enough to adversely affect the spring characteristics.

FIG. 1 shows sleeve 28 as being formed of a ceramic material, specifically silicon nitride or partially stabilized zirconia. The sleeve can be formed of other insulator materials. FIG. 2 fragmentarily illustrates the sleeve as being comprised of an outer steel annulus 72 and a zirconia liner 74. The outer side surface contour of annulus 72 would be similar to the contour depicted in FIG. 1.

Zirconia coating 74 would preferably extend the full length of the steel annulus to provide a continuous bearing surface for the piston. It might be desirable to increase the radial thickness of the zirconia coating near the upper end area of the steel annulus, for proportioning the insulator effect according to the expected heat load (highest at the upper end of the combustion chamber, and lowest at the lower end of the chamber).

In either case (FIG. 1 or FIG. 2) the sleeve is removable from block 10. Should the sleeve become worn or otherwise experience a failure a new replacement sleeve can be installed in block 10.

Variants of this concept are also possible. It is obvious that the principles of this invention could also be applied by use of a sleeve having only two different diameter sections by providing the spring means at the single step thus formed. Such could be achieved by eliminating step 80 in the upper sleeve such that surfaces 38 and 40 have the same diameter.

This invention may also be combined with other known design features such as a chocked sleeve bore. (By tapering the cold dimensions of the sleeve bore to a smaller diameter at its upper end, thermal growth of the bore under operating conditions will result in a substantially cylindrical bore to improve the operation of the piston and rings).

I wish it to be understood that I do not desire to be limited to the exact details of construction shown and described for obvious modifications will occur to a person skilled in the art, without departing from the spirit and scope of the appended claims.

I claim:

1. In a piston engine comprising an engine having a cylindrical bore therein, and a cooperating engine head closing the bore: the improvement comprising a sleeve extending concentrically through the bore; the inner side surface of said sleeve being designed to slidably support a piston; the outer side surface of said sleeve having a step configuration defining a first annular shoulder facing away from the cylinder head; the bore having a step configuration defining a second annular shoulder facing the cylinder head; said second shoulder being further away from the cylinder head than the first shoulder, whereby an annular free space is formed between the two shoulders; a compression spring means located in the annular free space; said spring means being trained between the two shoulders to bias the sleeve toward the cylinder head; said sleeve having a sliding fit in the bore whereby the sleeve can undergo changes in its length in response to thermal stresses associated with the combustion process; said spring means having sufficient strength to maintain the sleeve in pressure contact with the cylinder head while at the same time accommodating axial thermal growth of the sleeve; the engine further including a protection means for isolating the sleeve from radially directed thermal or mechanical distortions of the cylindrical bore and for dampening the vibrations transferred to the sleeve from the engine block, the protection means being comprised of an annular portion of the cylinder bore surface remote from the end of the bore at the cylinder head, an opposing portion of the sleeve surface defining with the remote cylinder bore surface portion a toroidal gap, and a stationary body of fluid filling the toroidal gap.

2. The improvement of claim 1 wherein the sleeve is a steel sleeve having a liner therein formed of zirconia that has insulating properties for retarding the flow of heat from the combustion chamber into the block.

3. The improvement of claim 1 and further comprising two axially spaced oil grooves formed in the bore surface near the end of sleeve that is in pressure contact with the cylinder head; the bore surface area between the two oil grooves being spaced radially outward from the sleeve side surface; one of the oil grooves communicating with the high pressure side of the engine lubricating system, and the other oil groove communicating with the low pressure side of the engine lubrication system, whereby oil circulates through the annular space between the bore and sleeve to thereby remove combustion chamber heat that passes radially through the sleeve.

4. The engine of claim 3 wherein the torroidal gap of the spacer means communicates with a single one of the oil grooves in the bore surface whereby the torroidal gap is filled with lubricating oil from the engine lubrication system, and whereby the oil in the torroidal gap experiences substantially no flow.

5. The engine of claim 4 wherein the radial dimension of the torroidal gap is approximately 0.003 inches.

6. The improvement of claim 4 wherein the sleeve is formed of a ceramic material, whereby the sleeve has insulating properties that retard the flow of heat from the combustion chamber into the block.

7. The improvement of claim 6 wherein the section of the sleeve in near adjacency to the cylinder head has an increased radial thickness compared to that of the remaining sections of the sleeve, whereby the thickened sleeve section exhibits a relatively high resistance to flow of heat from the combustion chamber into the block and has higher strength to resist hoop stresses generated by combustion within the cylinder.

8. In a piston-cylinder engine comprising a cylinder block having a bore therein, a cylinder head clamped to the block to close the bore, and a sleeve fitting within the bore to slidably support a piston: the improvement wherein the bore includes a first relatively large diameter section in near adjacency to the cylinder head, a second intermediate diameter section extending axially from the first section away from the cylinder head, and a third relatively small diameter section extending axially from the second section; the juncture between the second and third bore sections defining a first annular shoulder; the sleeve having an inner side surface of constant diameter from one end of the sleeve to the other; the outer side surface of the sleeve having a step configuration to form a first large diameter surface area in radial alignment with the first section of the bore, a second intermediate diameter surface area in radial alignment with the second section of the bore, and a third small diameter surface area in radial alignment with the third section of the bore; the juncture between the sleeve second surface area and third surface area defining a second annular shoulder; said first shoulder being further away from the cylinder head than the second shoulder, whereby an annular free space is formed between the two shoulders; and compression spring means located in the annular free space; said spring means being trained between the two shoulders to bias the sleeve toward the cylinder head; said sleeve having a sliding fit in the bore whereby the sleeve can undergo changes in its length in response to thermal stress associated with the combustion process; said spring means having sufficient strength to maintain the sleeve in pressure contact with the cylinder head while at the same time accommodating axial thermal growth of the sleeve; wherein the second section of the bore and the second surface of the sleeve define a radial gap there between; the improvement further comprising a liquid spacer means for isolating the sleeve from the thermal or mechanical distortions in the radial direction of the cylindrical bore and for dampening the vibrations transferred to the sleeve from the engine block, the spacer means being comprised of substantially stationary fluid within the gap.

9. The improvement of claim 8 wherein the sleeve outer side surface is dimensioned to provide an annular clearance space between the first section of the bore and the first surface area of the sleeve; and two axially spaced oil grooves formed in the first section of the bore; one of the oil grooves being in communication with the high pressure side of the engine lubrication system, and the other oil groove being in communication with the low pressure side of the engine lubrication system, whereby oil can circulate through the annular clearance space to thereby remove residual combustion chamber heat.

10. The improvement of claim 9 wherein the sleeve is formed of a material that has insulating properties, for thus retarding the flow of combustion chamber heat into the block.

11. The improvement of claim 10 wherein the sleeve is formed of silicon nitride.

12. The improvement of claim 10 wherein the sleeve is a steel annulus and a zirconia liner.

13. The engine of claim 9 wherein the torroidal gap of oil grooves in the bore surface and is filled with lubricating oil from the engine lubrication system.

14. The engine of claim 13 wherein the radial dimension of the torroidal gap is approximately 0.003 inches

* * * * *